US005557819A

United States Patent [19]

Krolikowski

[11] Patent Number: 5,557,819

[45] Date of Patent: Sep. 24, 1996

[54] POOL CLEANER WITH WEIGHTED HOSE

[75] Inventor: Anthony E. Krolikowski, Royal Oak, Mich.

[73] Assignee: Innovating Corporation, Royal Oak, Mich.

[21] Appl. No.: 492,470

[22] Filed: Jun. 20, 1995

[51] Int. Cl.[6] ..... E04H 3/20

[52] U.S. Cl. ..... 15/1.7; 134/167 R; 134/168 R

[58] Field of Search ..... 15/1.7; 134/167 R, 134/168 R; 138/103, 178; 4/496

[56] References Cited

U.S. PATENT DOCUMENTS

| | | | |
|---|---|---|---|
| 3,108,298 | 10/1963 | Gelnas | 15/1.7 |
| 4,282,893 | 8/1981 | Kane | 15/1.7 |
| 4,346,484 | 8/1982 | Martin | 134/168 R |
| 4,753,256 | 6/1988 | Chivens et al. | 134/166 R |
| 4,768,532 | 9/1988 | Johnson | 15/1.7 |
| 5,082,028 | 1/1992 | Jean-Jacques | 15/1.7 |
| 5,398,361 | 3/1995 | Cason | 15/1.7 |

*Primary Examiner*—Gary K. Graham
*Attorney, Agent, or Firm*—John R. Benefiel

[57] ABSTRACT

An improved pool cleaner hose assembly is provided for use in drawing water under a negative pressure from a manually operated pool cleaner device to a water filtration system for swimming pools and the like. Improvements relate to enhancements in the view of the operator on debris at the bottom of the swimming pool during cleaning operation. The hose assembly is coupled between the cleaner device and filtration system. An improved cleaner hose assembly comprising a conventional extruded plastic hose and a plurality of weights attached along the length of the hose to orient the hose at the lowest profile on the pool floor whereby imparting minimum disturbance to the water surface and enhancing the view of the operator.

5 Claims, 3 Drawing Sheets

POOL CLEANER WITH WEIGHTED HOSE

This is a substitute of application Ser. No. 08/213,922, filed Mar. 14, 1994, abandoned.

BACKGROUND

1. Field of Invention

This invention relates generally to cleaner devices and related equipment for use in cleaning swimming pools and the like. More specifically, this invention relates to improvements in a vacuum hose used for drawing water under a negative pressure from a manually operated pool cleaner device to a water filtration system. Improvements relate to enhancement in the view of the operator on debris at the bottom of the swimming pool during cleaning operation.

2. Discussion of Prior Art

Manually operated pool cleaner devices in general are well known in the art to assist in maintaining the cleanliness of a swimming pool or the like. Such manually operated cleaning devices are typically coupled to a filtration system with an elongated flexible hose. An operator maneuvers the cleaner device over debris and throughout the pool as required to clean the pool floor. A vacuum nozzle, brushes within the vacuum nozzle and a pole are commonly included on the cleaner device that functions to dislodge dirt and debris within the swimming pool for collection inside the cleaner device, hose and to the filtration system.

A pool cleaning device of the above-described type couples to an elongated flexible cleaner hose that draws water under a negative pressure from the swimming pool to the inlet of the pool filtration system. Such cleaner hoses are typically constructed from lightweight and preferably inexpensive plastic material that will naturally float in water. Such cleaner hoses will float near the surface of the water because the plastic material is lighter than water. A moving hose that floats will cause disturbance of the water surface with ripples when operated during the process of cleaning the pool. The rippling water blurs the vision of the debris at the bottom of the pool making it difficult for the operator to see and target debris thus increasing the time to clean the pool floor.

In-the-pool cleaner devices such as described in U.S. Pat. No. 3,972,339 are typically installed in the swimming pool and include a water powered means for travel in a random fashion throughout the pool. Water jets are commonly included on the in-the-pool devices and function to dislodge and suspend dirt for collection by circulation in a conventional swimming pool filtration system. The in-the-pool devices are not effective and consume much energy in cleaning. These devices travel throughout the pool in a random fashion with no intelligence as to where the debris may lie. These in-the-pool cleaner devices will repeatedly clean the same area while requiring extended filtration time and energy. Such in-the-pool cleaner devices can not travel around corners, sides and upright obstacles thus requiring the use of the manually operated pool cleaner device intermittently. Furthermore, these in-the-pool cleaners will dirty the swimming pool water with the debris for circulation and indirectly into the pool filtration system. Small particles of debris will not enter the filtration system directly and remain suspended in the pool water for a while.

OBJECTS AND ADVANTAGES

This invention provides a simple and inexpensive solution to the constant blurred vision of the water surface from a floating moving hose that impedes the process of cleaning the swimming pool. The invention causes the vacuum hose to rest below the water level where the overlying water subdues the motion of the hose. The invention maintains the vacuum hose below the water level to produce a flat and undisturbed water surface that is exceptional in viewing and scrubbing the pool floor throughout the cleaning process.

There exists, therefore, a significant need for an improved cleaner hose for use with a manually operated pool cleaner device and the like wherein the vacuum hose adapts to impart substantially minimum rippling to the water surface during cleaner operation. The present invention fulfills these needs and provides further related advantages.

An alternative cleaner hose configuration have been proposed as described in U.S. Pat. No. 4,753,256 in the form of a partially buoyant flexible hose that is connected to an in-the-pool cleaner device and to a positive water supply on the discharge end of the filter system. Such cleaner hose design with a combined high profile portion floating and a low profile portion creates a configuration suitable to minimize drag to the in-the-pool cleaner device and maximize the wheel traction to the in-the-pool cleaner. Such cleaner hose will not minimize the rippling water surface because a major portion of the hose is exposed at the water surface thus creating a rippled surface when operated.

The present invention proposes a non-buoyant flexible hose that connects to a manually operated cleaner device and the inlet side of the filtration system. Such cleaner hose design imparting a full submerged length with a plurality of anti-ripple devices creates a flat profile of the hose thus minimizing rippling of the water surface and enhancing the view of the operator while scrubbing debris.

DESCRIPTION OF DRAWINGS

The accompanying drawings illustrate the invention. In Such drawings.

REFERENCE NUMERALS IN DRAWINGS

Figure 1:
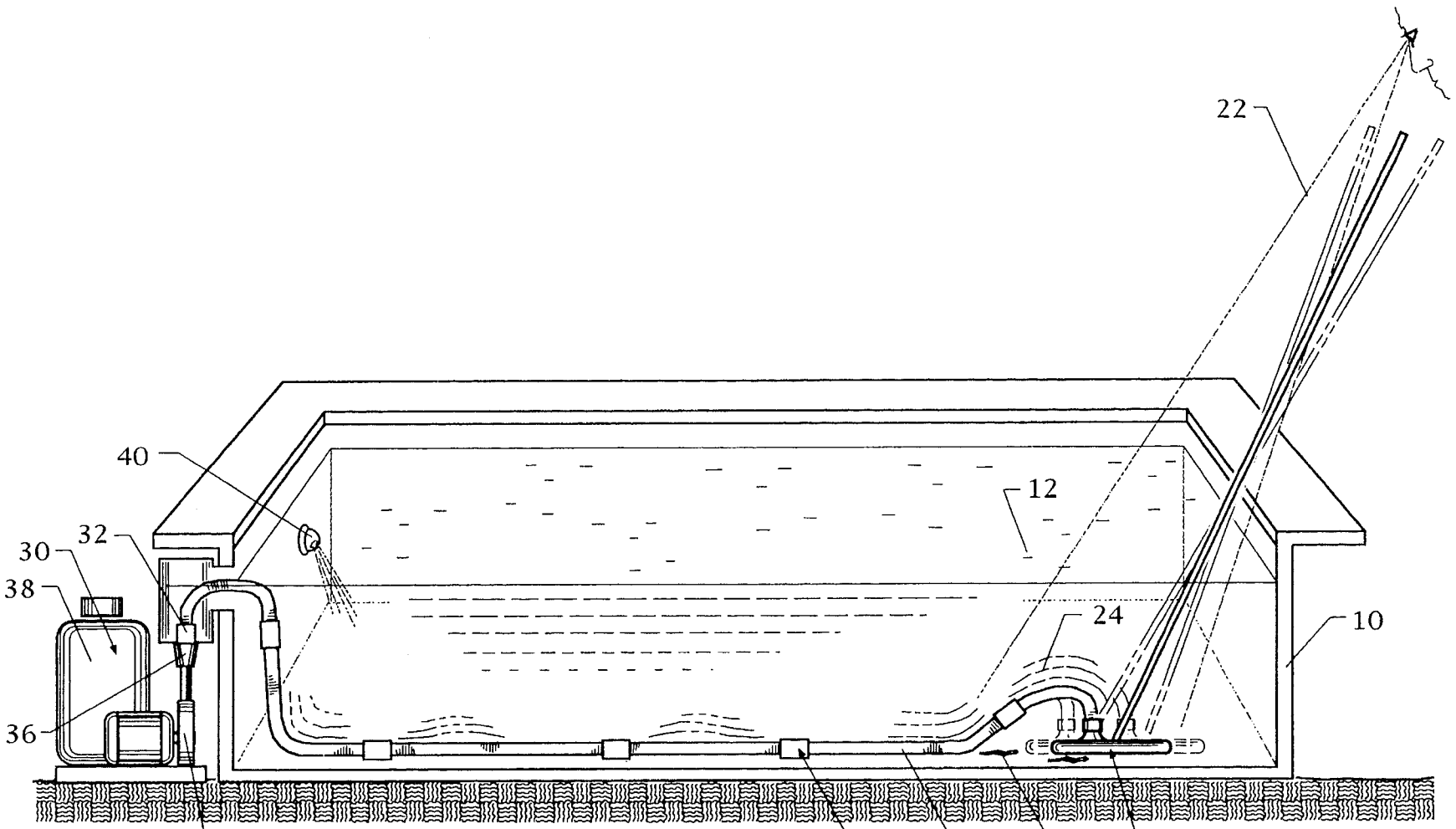
FIG. 1 is a fragmented somewhat diagrammatic view depicting an improved pool cleaner hose embodying the novel features of the invention and shown in operation connection with a manually operated pool cleaner device.

10 swimming Pool Assembly
12 Water
14 Debris
16 Manually Operated Cleaning Device
18 Cleaner Hose
20 Anti-Ripple Device
22 View of the Operator
24 Motion of the Cleaner Hose
30 Filtration System
32 Inlet of Filtration System
34 Pump of Filtration System
36 Strainer of Filtration System
38 Filtrate Media of Filtration System

40 Outlet of Filtration System
50 Brushes of Cleaning Device
52 Nozzle of Cleaning Device
54 Pole of Cleaning Device
60 Bar Weight of Anti-Ripple Device
62 Hole in Bar Weight
64 Major Outside Diameter of Cleaning Hose
66 Minor Outside Diameter of Cleaning Hose
68 Knot of Anti-Ripple Device
70 Cord of Anti-Ripple Device

SUMMARY OF THE INVENTION

In accordance with the invention, an improved submerged cleaner hose provides utility in combination with manually operated pool cleaners and the like to enhance the viewing of the operator while dislodging dirt and debris from submerged pool floor surfaces. The improved pool cleaner hose comprises a conventional, inexpensive, lightweight and flexible hose constructed from extruded plastic tubing. The hose is adapted for connection between the pool cleaner and the pump inlet side of the swimming pool filtration system. A plurality of anti-ripple devices is mounted at a uniform spacing on the hose causing the entire length of the hose to rest on the submerged swimming pool floor during operation imparting minimum rippling to the water surface and enhances the operator viewing while scrubbing debris.

In a preferred form of the invention, the pool cleaner hose is of a conventional design with convoluted wall configuration imparting a flexible tube constructed of an inexpensive plastic material with a specific gravity less than that of water. The hose connects to the pool cleaner and the pump inlet side of a swimming pool filtration system with a drawing supply of water under a negative pressure.

The elongated pool cleaner hose is relatively buoyant within the pool water. In a preferred form of the invention, the anti-ripple device is constructed from a thin rectangular bar with a specific gravity much greater than that of water. The bar is sized to produce a gravity force greater than the buoyancy force of a tributary portion of plastic hose causing the anti-ripple device, and hose to rest flatly on the submerged pool floor. The bar width bends radial over the hose diameter and length positions parallel to the cleaner hose in a streamlining configuration. An elongated cord coils tautly around the assembly of the bar and hose within the grooves of the hose provided by the convoluted wall. Two holes with diameters larger than the cord diameter are located at each end of the bar length and provide a means to fasten the cord to the bar. The cord is applied with tension to produce a tight assembly of weight, cord and hose into one structural embodiment. Anti-ripple devices mounted along the entire length of the hose with a uniform spacing will cause the hose to rest on the submerged pool floor during cleaning operation. Accordingly, the cleaner hose exhibits a flat horizontal profile at the pool floor to impart minimum rippling of the water surface and enhance the view of the operator while scrubbing debris.

Other features and advantages of the present invention will become more apparent from the following detailed description, taken in conjunction with the accompanying drawings, which illustrate, by way of example, the principles of the invention.

DETAILED DESCRIPTION OF THE PREFERRED EMBODIMENT

As shown in the exemplary drawings, an improved submerged cleaner hose 18 provides utility in combination with a manually operated cleaner device 16 for cleaning a swimming pool 10 or the like. The cleaner hose 18 is of a conventional design with convoluted wall configuration imparting a flexible tube constructed of an inexpensive plastic material with a specific gravity less than the specific gravity of the pool water 12. A plurality of anti-ripple devices 20 mounted at a uniform spacing to the cleaner hose 18 causes the hose 18 to rest on the submerged swimming pool 10 floor during operation imparting minimum rippling to the water 12 surface and enhancing the view of the operator 22 while cleaning debris 14. The pool cleaner 16 is maneuvered over debris 14 and throughout the pool 10 as required to clean the pool floor 10.

As depicted in FIG. 1, the improved cleaner hose 18 of the present invention advantageously provides a non-buoyant and flexible hose construction for drawing water 12 under negative pressure from the manually operated cleaning device 16. The cleaner hose 18 advantageously rest at the bottom of the submerged pool 10 floor thus preventing any hose motion 24 from creating waves or ripples at the water 12 surface and enhancing the view of the operator 22 while cleaning. A plurality of anti-ripple devices 20 may be mounted along the length of the hose 18 to prevent the hose motion 24 from reaching the water 12 surface.

In normal operation as depicted in FIG. 1, a pool cleaner 16 is swept over the debris 14, such as dirt, grit, leaves and other sediments, that lies on the floor and side walls of the swimming pool 10. Relatively large piece of debris 14 is drawn through the cleaning device 16 and hose 18 and collected by a basket strainer 36 within the filtration system 30 and removed periodically. Fine particulate debris 14 suspended in the water 12 is removed from the water 12 by a filtrate medium 38 such as sand within the filtration system 30. One end of the cleaner hose 18 is coupled to the cleaning device 16 and the other end of the cleaner hose 18 is coupled to the inlet of the filtration system 32. Water 12 is drawn through the inlet 32 with a pump 34 and forced through the filtrate medium 38 within the filtration system 30.

During the cleaning operation, the anti-ripple devices 20 keeps the hose 18 in a flat profile on the pool 10 floor and minimize the ripple at the surface of the water 12. The motion of the hose 24 is unable to cause waves at the water 12 surface that causes a blurred vision of the debris 14 at the bottom of the submerged pool floor 10.

Figure 2:
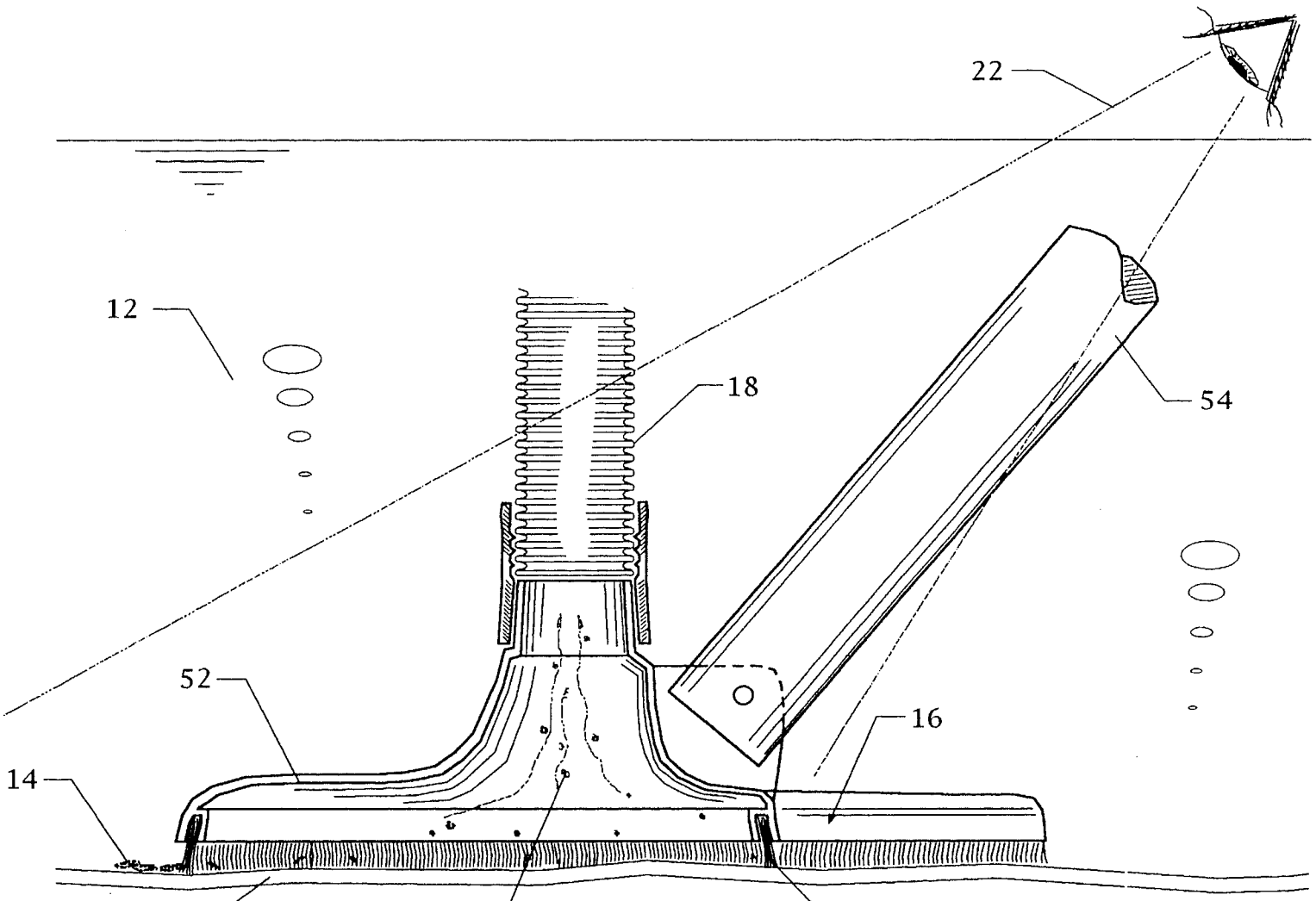
FIG. 2 is a fragmented somewhat diagrammatic and enlarged view depicting a manually operated cleaning device and shown in operation removing debris from the submerged pool floor.

More specifically, as depicted in FIG. 2, the pool cleaner device 16 comprises of a vacuum nozzle 52, brushes 50 and pole 54 whereas functions to dislodge debris 14 when maneuvered within the swimming pool 10. Water 12 is drawn from the cleaner device 16 while scrubbing the debris 14 with brushes 50 causing the debris 14 to lift and be carried within the cleaner hose 18 and to the filtration system 30.

Figure 3A:
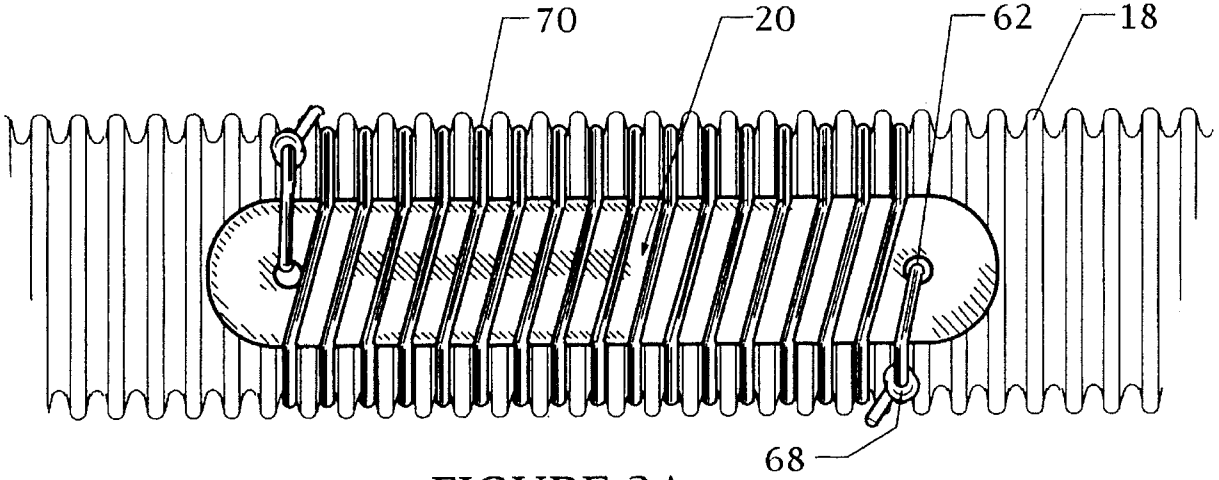
FIG. 3A, 3B and 3C are plan, side and cross views depicting a preferred anti-rippling device for use with the vacuum cleaner hose.
Figure 3B:
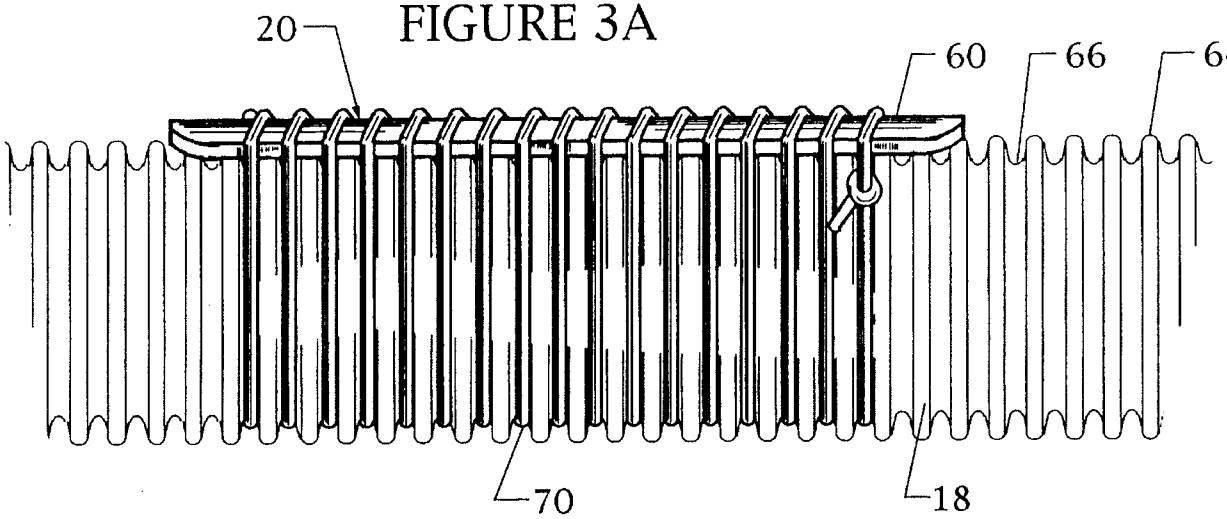
Figure 3C:
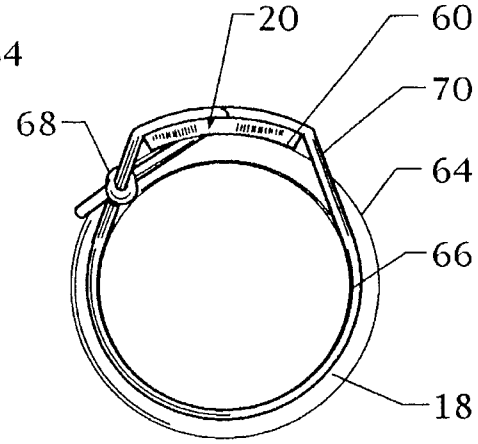

The improved cleaner hose 18 is shown in FIGS. 3A, 3B and 3C comprising of a conventional lightweight flexible tube with convoluted wall construction having consecutive major 64 and minor 66 outer diameters imparting a plurality of grooves and ridges for a flexible hose 18. An anti-ripple device 20 is mounted to the hose 18 exterior imposing a gravity force mass greater than the buoyancy force of a tributary length of hose 18 imparting a combined assembly of the hose 18 and anti-ripple device 20 to rest on the submerged pool floor 10.

As shown in FIG. 3A, the anti-ripple device 20 comprises of a bar weight 60, cord 70 and knot 68. The bar weight 60 is of a particular material that exhibits corrosive resisting properties to withstands the worst swimming pool 10 environment and has a specific gravity greater than the specific gravity of water 12. The bar 60 is a rectangular plate with a width that is a fraction of the circumference of the hose 18 and a length several times that of the width. As shown in FIG. 3C, the width of the bar 60 is bent to the same radius as the outer radius of the hose 18 to prevent the bar 60 from twisting about the hose 18. The thickness of the bar 60 is a fraction of the width of the bar 60. Two holes 62 with a diameter large enough for a cord 70 are centrally located at a specified distance from each end of the bar 60. The corners of the bar weight 60 are trimmed smooth to prevent any sharp protruding edges.

In assembly with the hose 18, the length of the bar weight 60 is parallel and beside the length of the hose 18 with the curved width matching the outer circumference of the hose 18 as shown in FIG. 3C. The bar 60 position provides a streamlining profile with the hose 18. A cord 70 that is an elongated piece made of a corrosive resistant material to the pool 10 environment and has a length that is several times longer than the bar weight 60 width. The cord 70 is threaded through one of the two holes 62 of the bar 60 and fastened by means of a knot 68. The other loose end of the cord 70 wraps tautly around the hose 18 through the grooves provided by the major 64 and minor 66 outer diameters of the hose 18. The loose end of the cord 70 wraps diagonally over the bar 60 to the next adjacent grooved away from the first hole 62. The end of the cord 70 continually wraps tautly around the hose 18 and bar weight 60 several times and is threaded through the second hole 62 of the bar 60 whereas the anti-ripple device 20 is fastened with another knot 68.

As shown if FIG. 3, the assembly of the bar 60, cord 70 and knots 68 provides a streamlined and flexible anti-ripple device 20. A plurality of these ant-ripple devices 20 mounted to the hose 18 at a specified spacing will maintain the hose 18 at the submerged pool 10 floor as shown in FIG. 1.

The improved pool cleaner hose 18 with the anti-ripple devices 20 of the present invention thus provides a light-weight, flexible and non-buoyant assembly adapted for long service life in swimming pool water 12 and the like. The hose 18 and anti-ripple devices 20 present the lowest profile imparting; minimum disturbance to the water 12 surface with waves or small ripples that blurs the view of the operator 22 during operation.

A variety of modifications and improvements to the invention described herein are believed to be apparent to those skilled in the art. Accordingly, no limitation on the invention is intended by way of the description and drawings, except as set forth in the appended claims.

What is claimed is:

1. A manually operated pool cleaner assembly comprising:

a pool cleaner suction nozzle and an elongated handle connected to said cleaner nozzle adapted to enable a person to maneuver said nozzle over debris on a submerged floor of a swimming pool:

an elongated flexible buoyant sealed hose connected at one end to said cleaner nozzle;

a pool filtration system connected to the other end of said hose to draw water under negative pressure into said cleaner nozzle;

and means for stabilizing a submerged length of said hose to rest on said pool floor during manipulation of said cleaner nozzle to minimize surface ripples and thereby maintain visibility of the pool bottom to a person maneuvering said cleaner nozzle with said elongated handle, said means generally comprising a plurality of weights mounted to and spaced apart along the length of said hose; said weights of sufficient mass to provide a gravitational force greater than the buoyancy force of an intervening length of said hose between said spaced apart weights.

2. The pool cleaner hose assembly of claim 1 wherein said hose is a plastic hose of convoluted wall construction.

3. The pool cleaner according to claim 2 further including a cord wrapped around each weight and a respective segment of said hose to detachably mount each weight to a respective segment of said hose.

4. The pool cleaner according to claim 3 wherein each weight is a streamlined elongated bar disposed with its length parallel to said hose.

5. The pool cleaner according to claim 4 wherein each weight has a hole at each end receiving said cord, said cord received in convolutions of said hose wall construction in being wrapped around said hose.

* * * * *